US008043025B2

(12) United States Patent
Hernandez-Torres et al.

(10) Patent No.: US 8,043,025 B2
(45) Date of Patent: Oct. 25, 2011

(54) MATS FOR USE IN PAVED SURFACES

(75) Inventors: Jesus Manuel Hernandez-Torres, Pataskala, OH (US); David R. Jones, IV, Tampa, FL (US); Liang Chen, New Albany, OH (US); Jeffery W. Smith, Lockport, IL (US); Timothy A. Miller, Newark, OH (US); Helen Y. Huang, New Albany, OH (US); Michael D. Samueloff, Troy, MI (US); Mohammed Tazi, New Albany, OH (US); Timothy R. Gilbert, Granville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 628 days.

(21) Appl. No.: 11/789,203

(22) Filed: Apr. 24, 2007

(65) Prior Publication Data

US 2007/0253773 A1 Nov. 1, 2007

Related U.S. Application Data

(63) Continuation-in-part of application No. 10/667,252, filed on Sep. 19, 2003, now Pat. No. 7,207,744, and a continuation-in-part of application No. 10/188,447, filed on Jul. 3, 2002, now Pat. No. 7,059,800, and a continuation-in-part of application No. 09/795,774, filed on Feb. 28, 2001, now Pat. No. 6,648,547.

(51) Int. Cl.
*E01C 3/00* (2006.01)

(52) U.S. Cl. ..... 404/31; 404/17; 442/59; 442/225; 442/328; 442/331; 442/333

(58) Field of Classification Search ..... 404/17–27
See application file for complete search history.

(56) References Cited

U.S. PATENT DOCUMENTS 1,751,565 A 3/1930 Talbott
(Continued)

FOREIGN PATENT DOCUMENTS

DE 195 43991 5/1997
(Continued)

OTHER PUBLICATIONS

International Search Report dated Jul. 25, 2008 in PCT/US2008/061204.

(Continued)

*Primary Examiner* — Raymond W Addie
(74) *Attorney, Agent, or Firm* — Calfee, Halter & Griswold LLP

(57) ABSTRACT

A paving mat for use in a paved surface includes a fibrous mat in the form of a paving mat. The fibrous mat includes a fibrous matrix containing a mixture of polymer fibers, first mineral fibers having a first median length, and second mineral fibers having a second median length that is different from the first median length. In another embodiment, the paving mat includes a fibrous mat including a fibrous matrix which is bonded together by a binder. In one embodiment, the binder is a mixture of different binders. The fibrous matrix includes a mixture of mineral fibers in an amount within a range of from 61 wt % to 85 wt % and polymer fibers in an amount within a range of from 15 wt % to 39 wt %. The polymer fibers have a melting point greater than 320° F. (160° C.). The mat has a stiffness in the machine direction within a range of from 65 g-cm to 110 g-cm. The mat has a load-elongation behavior such that when the mat is subject to tensile stress, the mat achieves at least 90% of its ultimate load at an elongation not greater than 5% of the specimen length in the direction of applied stress. Another embodiment of the paving mat is made with a carboxy-modified acrylic binder.

29 Claims, 4 Drawing Sheets

U.S. PATENT DOCUMENTS 2,115,667 A 4/1938 Ellis
2,373,239 A 4/1945 Fenn
2,578,883 A * 12/1951 Frick ..... 106/164.6
2,811,769 A 11/1957 Craig
2,903,189 A 9/1959 Patton
3,106,344 A 10/1963 Baird et al.
3,311,035 A 3/1967 Poskey et al.
3,557,671 A 1/1971 Vasllоff
3,844,669 A 10/1974 Eigenmann
3,856,732 A 12/1974 Bresson et al.
3,869,417 A 3/1975 Ramsay
3,931,439 A 1/1976 Bresson et al.
3,932,051 A 1/1976 Cleary
3,964,835 A 6/1976 Eigenmann
4,012,247 A 3/1977 Eigenmann
4,074,948 A 2/1978 Heater, Jr.
4,112,174 A * 9/1978 Hannes et al. ..... 428/220
4,141,187 A * 2/1979 Graves ..... 52/173.1
4,151,025 A 4/1979 Jacobs
4,159,877 A 7/1979 Jacobson et al.
4,165,192 A 8/1979 Mellen
4,175,978 A 11/1979 Marzocchi et al.
4,242,173 A 12/1980 Stenemann
4,251,586 A 2/1981 Marzocchi et al.
4,258,098 A 3/1981 Bondoc et al.
4,259,127 A 3/1981 Schachter
4,265,559 A 5/1981 Mellen
4,265,563 A 5/1981 Marzocchi et al.
4,299,874 A 11/1981 Jones et al.
4,319,854 A 3/1982 Marzocchi
4,344,571 A 8/1982 Kundig
4,359,546 A 11/1982 Bershas
4,362,780 A 12/1982 Marzocchi et al.
4,404,244 A 9/1983 Springston
4,425,399 A 1/1984 Bershas
4,472,243 A 9/1984 Bondoc et al.
4,508,770 A 4/1985 Muncaster et al.
4,522,875 A 6/1985 Still, Jr. et al.
4,540,311 A 9/1985 Leach
4,588,443 A * 5/1986 Bache ..... 106/644
4,617,219 A 10/1986 Schupack
4,629,358 A 12/1986 Springston et al.
4,637,946 A 1/1987 Shah et al.
4,649,169 A 3/1987 Thompson et al.
4,678,699 A 7/1987 Kritchevsky et al.
4,681,802 A * 7/1987 Gaa et al. ..... 442/327
4,684,289 A 8/1987 Gnesa
4,699,542 A 10/1987 Shoesmith
4,720,043 A 1/1988 Ortwein
4,749,625 A 6/1988 Obayashi et al.
4,793,731 A 12/1988 Gnesa
4,810,576 A 3/1989 Gaa et al.
4,826,718 A 5/1989 Unsworth et al.
4,834,577 A 5/1989 Perfetti
4,856,930 A 8/1989 Denning
4,863,789 A 9/1989 Arai
4,885,659 A 12/1989 Nowell et al.
4,923,559 A 5/1990 Kennedy et al.
4,957,390 A 9/1990 Shoesmith
4,960,242 A 10/1990 Larson
4,980,223 A 12/1990 Nakano et al.
4,996,095 A 2/1991 Behdorf et al.
5,026,609 A 6/1991 Jacob et al.
5,028,490 A 7/1991 Koskenmaki et al.
5,082,393 A 1/1992 Ringesten et al.
5,110,627 A 5/1992 Shoesmith et al.
5,120,217 A 6/1992 O'Brien et al.
5,124,198 A 6/1992 Koskenmaki et al.
5,165,990 A * 11/1992 Nakano ..... 428/297.4
5,174,228 A 12/1992 Grimes
5,226,210 A 7/1993 Koskenmaki et al.
5,239,615 A 8/1993 Moore et al.
5,246,306 A 9/1993 Shoesmith et al.
5,260,128 A 11/1993 Ishii et al.
5,273,804 A 12/1993 Brian et al.
5,366,308 A 11/1994 Crispino
5,366,309 A 11/1994 Springall
5,387,051 A 2/1995 Valente
5,393,559 A 2/1995 Shoesmith et al.
5,468,546 A 11/1995 Loftus et al.
5,490,961 A 2/1996 Bakhshi et al.
5,494,228 A 2/1996 Eaton et al.
5,494,728 A 2/1996 Vermilion et al.
5,521,305 A 5/1996 Huber et al.
5,622,023 A 4/1997 Crispino
5,711,834 A 1/1998 Saito
5,718,787 A 2/1998 Gallagher et al.
5,789,329 A 8/1998 Eastes et al.
5,803,656 A 9/1998 Turck
5,804,003 A 9/1998 Nishizawa
5,827,430 A 10/1998 Perry et al.
5,836,715 A 11/1998 Hendrix et al.
5,869,412 A 2/1999 Yenni, Jr. et al.
5,869,413 A 2/1999 Gallagher et al.
5,897,946 A 4/1999 Nachtman et al.
5,897,951 A * 4/1999 Gallagher et al. ..... 428/364
5,910,458 A 6/1999 Beer et al.
5,941,656 A 8/1999 Sugiyama et al.
5,955,386 A 9/1999 Horton
6,013,376 A 1/2000 Yenni, Jr.
6,043,169 A 3/2000 Jaffee
6,093,247 A 7/2000 Sipos et al.
6,123,879 A 9/2000 Hendrix et al.
6,206,607 B1 3/2001 Medico, Jr. et al.
6,235,136 B1 5/2001 Kittson et al.
6,235,378 B1 5/2001 Lowder
6,398,899 B1 6/2002 Umezawa et al.
6,412,154 B1 7/2002 Plotz
6,426,309 B1 7/2002 Miller et al.
6,440,529 B1 8/2002 Baumgart et al.
6,503,853 B1 1/2003 Kassner et al.
6,548,155 B1 * 4/2003 Jaffee ..... 428/297.4
6,586,353 B1 7/2003 Kiik et al.
6,630,046 B1 10/2003 Plotz
6,648,547 B2 11/2003 Jones et al.
6,723,670 B2 4/2004 Kajander et al.
6,737,369 B2 * 5/2004 Peng et al. ..... 442/157
6,770,169 B1 8/2004 Wallace
6,841,230 B2 1/2005 Yokoo et al.
6,851,240 B2 2/2005 Peng et al.
6,872,440 B1 3/2005 Kiik et al.
6,875,308 B2 4/2005 Kajander et al.
6,913,785 B2 7/2005 Morton
7,059,800 B2 6/2006 Jones et al.
7,207,744 B2 4/2007 Jones, IV et al.
2002/0001506 A1 1/2002 Wilson, Sr.
2002/0155289 A1 10/2002 Cistone et al.
2003/0016999 A1 1/2003 Jones, IV
2003/0026654 A1 2/2003 Jones
2003/0054714 A1 * 3/2003 Peng et al. ..... 442/71
2003/0086762 A1 5/2003 Oka et al.
2004/0013884 A1 1/2004 Plotz
2004/0120765 A1 6/2004 Jones, IV et al.
2004/0185240 A1 9/2004 Morton
2005/0136241 A1 6/2005 Kajander et al.
2005/0208861 A1 9/2005 Dwiggins et al.
2007/0253773 A1 11/2007 Huang et al.

FOREIGN PATENT DOCUMENTS

EP 413295 2/1991
EP 763505 3/1997
EP 1158098 11/2001
EP 1 584 724 10/2005
EP 1379732 10/2005
EP 1584724 10/2005
FR 2767543 8/1997
FR 2777577 4/1998
JP 406248609 9/1994
JP 406346405 12/1994
JP 408013408 1/1996
JP 408199072 8/1996
JP 2000/027109 1/2000
JP 2001/234505 8/2001
WO 00/18574 4/2000
WO 00/61850 10/2000
WO 02/35004 5/2002
WO WO 02/068759 9/2002

| | | |
|---|---|---|
| WO | 04/05622 | 1/2004 |
| WO | 05/33410 | 4/2005 |
| WO | 08/134331 | 11/2008 |

OTHER PUBLICATIONS

International Search Report from PCT/US02/05972 dated Jun. 26, 2002.
International Preliminary Examination Report from PCT/US02/05972 dated Jun. 2, 2003.
International Search Report from PCT/US03/19380 dated Sep. 11, 2003.
International Preliminary Examination Report from PCT/US03/19380 dated Oct. 11, 2004.
International Search Report and Written Opinion from PCT/US04/29972 dated Apr. 26, 2005.
International Search Report and Written Opinion from PCT/US08/61204 dated Jul. 25, 2008.
Office action from U.S. Appl. No. 10/667,252 dated Dec. 6, 2004.
Office action from U.S. Appl. No. 10/667,252 dated May 9, 2005.
Advisory Action from U.S. Appl. No. 10/667,252 dated Jul. 15, 2005.
Office action from U.S. Appl. No. 10/667,252 dated Jan. 3, 2006.
Office action from U.S. Appl. No. 10/667,252 dated Apr. 21, 2006.
Office action from U.S. Appl. No. 10/667,252 dated Jul. 10, 2006.
Advisory Action from U.S. Appl. No. 10/667,252 dated Sep. 18, 2006.
Notice of Allowance from U.S. Appl. No. 10/667,252 dated Dec. 21, 2006.
Notice of Panel Decision from Pre-Appeal Brief Review from U.S. Appl. No. 10/667,252 dated Dec. 22, 2006.
Office action from U.S. Appl. No. 11/789,203 dated Dec. 1, 2009.
Notice of Allowance from U.S. Appl. No. 11/789,203 dated Dec. 3, 2010.
Office action from U.S. Appl. No. 10/188,447 dated May 19, 2003.
Office action from U.S. Appl. No. 10/188,447 dated Jun. 2, 2003.
Office action from U.S. Appl. No. 10/188,447 dated Oct. 28, 2003.
Office action from U.S. Appl. No. 10/188,447 dated Mar. 25, 2004.
Office action from U.S. Appl. No. 10/188,447 dated Jun. 17, 2004.
Office action from U.S. Appl. No. 10/188,447 dated Oct. 13, 2004.
Office action from U.S. Appl. No. 10/188,447 dated Mar. 22, 2005.
Advisory Action from U.S. Appl. No. 10/188,447 dated Aug. 24, 2005.
Notice of Allowance from U.S. Appl. No. 10/188,447 dated Nov. 8, 2005.
Communication from European Application No. 03763006.8 dated Nov. 29, 2005.
Communication from European Application No. 03763006.8 dated Nov. 21, 2006.
Communication from European Application No. 03763006.8 dated Sep. 10, 2008.
SF Brown & NH Thom, Association of Asphalt Paving Technologists 2001 Annual Meeting, A study of grid reinforced asphalt to combat reflection cracking.
TC Mirafi-Technical Data Sheet, Mirafi Mirapave 400.
The Amoco Petromat System, Installation, pp. 1-2 (Jan. 7, 2001).
The Amoco Petromat System, Introduction, p. 1 (Jan. 7, 2001).
The Amoco Petromat System, Other Considerations, p. 1 (Jan. 7, 2001).
The Amoco Petromat System, Benefits, p. 1 (Jan. 7, 2001).
Office action from Taiwanese Application No. 93127002 dated Nov. 2, 2010.
Office action from U.S. Appl. No. 09/795,774 dated Jul. 15, 2002.
Office action from U.S. Appl. No. 09/795,774 dated Jan. 10, 2003.
Notice of Allowance from U.S. Appl. No. 09/795,774 dated May 6, 2003.
Communication from U.S. Appl. No. 09/795,774 dated Jul. 29, 2003.
Office action from U.S. Appl. No. 10/191,956 dated Jul. 2, 2003.
Office action from Canadian Application No. 2,491,481 dated Dec. 14, 2009.
Office action from Chinese Application No. 2002807139.5 dated Sep. 24, 2004.
Office action from Chinese Application No. 20038156334 dated Dec. 8, 2006.
Office action from Chinese Application No. 20038156334.4 dated Jun. 8, 2007.
Office action from Chinese Application No. 200880017262.1 dated Mar. 30, 2011.
Office action from Indian Application No. 0001/KOLNP/2005 dated Sep. 17, 2009.
Office action from Indian Application No. 1068/KOLNP/2003 dated Jun. 7, 2008.
Office action from Korean Application No. 2003-7011027 dated Nov. 26, 2007.
Office action from Malaysian Application No. 20020558 dated Dec. 27, 2005.
Office action from Norwegian Application No. 20033795 dated Nov. 16, 2005.
Office action from Philippine Application No. 1-2002-00115 dated Jul. 15, 2005.
Office action from Philippine Application No. 1-2002-00115 dated Oct. 28, 2005.
Office action from Russian Application No. 2003126572 dated Feb. 15, 2006.
Office action from Russian Patent Application No. 2003126572 dated Aug. 1, 2006.
Office action from Russian Application No. 2003126572 dated Jan. 2, 2007.
Office action from Russian Application No. 2005101739 dated Jul. 13, 2007.
Office action from Russian Application No. 2005101739 dated Mar. 31, 2008.
Office action from Taiwanese Application No. 92203689 dated Dec. 10, 2002.
Office action from Indian Application No. 0001/KOLNP/2005 dated May 5, 2010.

* cited by examiner

MATS FOR USE IN PAVED SURFACES

CROSS-REFERENCE TO RELATED APPLICATION

This application is a continuation-in-part of pending U.S. application Ser. No. 10/667,252, filed Sep. 19, 2003, the disclosure of which is incorporated herein by reference.

TECHNICAL FIELD AND INDUSTRIAL APPLICABILITY OF THE INVENTION

This invention relates in general to paved surfaces such as roads and parking lots, and in particular to a paving mat for use in a paved surface.

BACKGROUND OF THE INVENTION

Paved surfaces such as roads and parking lots are commonly constructed with a top surface layer of asphalt or concrete paving material. Over a period of time, the paved surface usually deteriorates due to the effects of traffic, temperature cycles, and other environmental causes. Cracks develop in the paved surface, and the cracks can spread and cause further deterioration. Water can penetrate the paved surface by flowing into the cracks, causing further damage.

Damaged paved surfaces are usually repaired by applying a new surface layer of paving material over the damaged portions or over the entire paved surface. After a paved surface having cracks is resurfaced, many times the new surface layer cracks directly over the cracks in the old surface, an occurrence known as "reflective cracking." One way to address this problem is to make the new surface layer thicker, but this is not very effective.

Consequently, various materials have been tried for waterproofing and for preventing or repairing cracks and other deterioration in paved surfaces. Some commercial products are needle-punched non-woven mats or geotextile fabrics constructed from polypropylene fibers. The product is applied over a hot tack coat of asphalt, and then a surface layer of hot asphalt paving material is applied over the mat. Unfortunately, the products made with polypropylene fibers tend to shrink, stretch and/or melt when they are exposed to the hot tack coat and/or hot paving material, which detracts from their effectiveness.

Another commercial product is the TruPave® Paving Mat developed by Owens Corning. This product is a non-woven mat constructed from a mixture of glass and polyester fibers. Compared with the polypropylene products, this product is more resistant to shrinking, stretching and melting, and it has improved strength.

Some patents describe different types of fibrous mats. For example, U.S. Pat. No. 4,359,546 discloses a non-woven paving mat made from a mixture of glass fibers and polymer fibers. Preferably, the glass fibers are from 6.35 mm to 50.8 mm in length and comprise about 60 to 80 percent by weight of the mat fibers. The polymer fibers are preferably from 25 mm to 40 mm in length and comprise up to about 40 percent of the mat fibers. The mat is made with a binder that includes from 91% to 97% aqueous thermoplastic emulsion, from 3% to 7% melamine formaldehyde resin and up to 2% water-soluble ammonium salt catalyst.

U.S. Pat. No. 6,737,369 discloses a non-woven roofing mat made from glass fibers, polymer fibers, or mixtures thereof. A majority of the fibers present in the mat are preferably unmixed glass fibers. The mat fibers have different fiber lengths. Specifically, the mat comprises a mixture of fibers where from 0 to 100 percent of the fibers have a median length of from 0.5 mm to 60 mm, and from 0 to 100 percent of the fibers have a median length of from 10 mm to 150 mm. The mat is made with any conventional binder, such as acrylamide, starch, urea resin, phenol resin, sodium silicate, epoxy resin, styrene-butadiene rubber, acryic, neoprene or acrylonitrile.

U.S. Patent Application Publication No. 2005/0136241 discloses a non-woven fibrous mat coated with foam for use as an exterior wallboard facing. Preferably, the majority of the fibers are glass fibers, but polymer fibers can be mixed with the glass fibers. The fibers are at least 6 mm long, and mixtures of different length fibers can be used. The binder used to bond the fibers together can include urea formaldehyde modified with acrylic.

U.S. Pat. No. 6,586,353 discloses a roofing mat made from glass fibers, polymer fibers or mixtures thereof. In a preferred embodiment, the mat is made from glass fibers bonded together by a binder comprising 75% to 99% urea formaldehyde and 1% to 25% acrylic latex.

U.S. Pat. No. 6,630,046 discloses a wall or floor fiberglass containing mat wherein up to 40% of the glass fibers can be substituted by other fibers, including polymer fibers. The binder for the mat can include acrylic or urea formaldehyde.

In view of the above, it would be desirable to provide a further improved paving mat for use in paved surfaces.

SUMMARY OF THE INVENTION

The invention relates to a paving mat for use in a paved surface. The paving mat comprises a fibrous mat in the form of a paving mat, the fibrous mat including a fibrous matrix comprising a mixture of polymer fibers, first mineral fibers having a first median length, and second mineral fibers having a second median length that is different from the first median length.

Another embodiment of a paving mat comprises a fibrous mat including a fibrous matrix which is bonded together by a binder. In one embodiment, the binder comprises a mixture of different binders. The fibrous matrix comprises a mixture of mineral fibers in an amount within a range of from 61 wt % to about 85 wt % and polymer fibers in an amount within a range of from about 15 wt % to 39 wt %. The polymer fibers have a melting point greater than about 320° F. (160° C.). The mat has a stiffness in the machine direction within a range of from about 65 g-cm to about 110 g-cm. The mat has a load-elongation behavior such that when the mat is subject to tensile stress, the mat achieves at least 90% of its ultimate load at an elongation not greater than 5% of the specimen length in the direction of applied stress.

Another embodiment of the invention relates to a paving mat made with a carboxy-modified acrylic binder.

Various aspects of this invention will become apparent to those skilled in the art from the following detailed description of the preferred embodiments, when read in light of the accompanying drawings.

DETAILED DESCRIPTION AND PREFERRED EMBODIMENTS OF THE INVENTION

Figure 1:
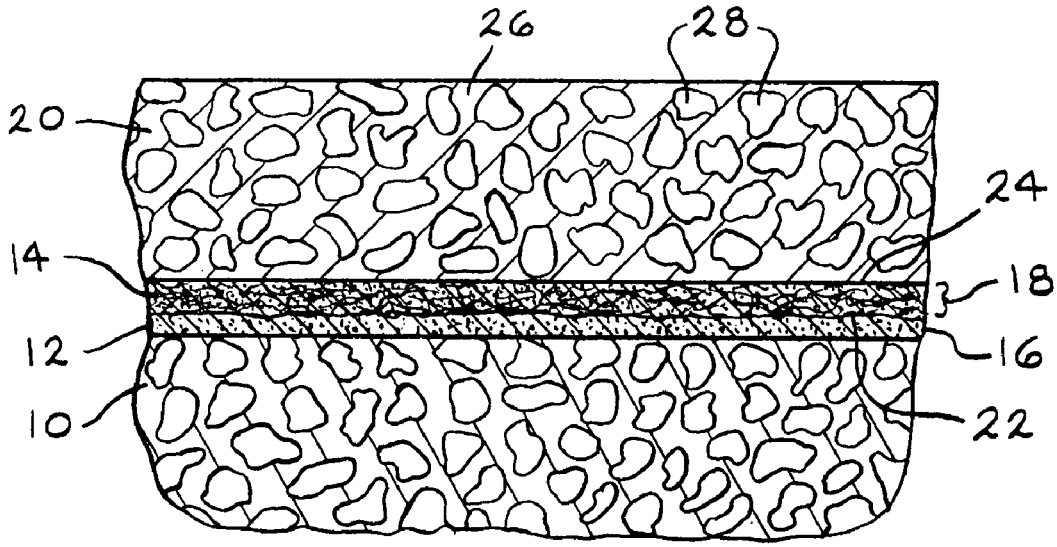
FIG. 1 is a cross-sectional view in elevation of a paved surface including a one-layer paving mat according to the invention.

The present invention relates to paving mats suitable for use in paved surfaces such as roads, parking lots or other types of paved surfaces. The paving mat can be used in the construction of a new paved surface, in the rejuvenation of an existing paved surface, or to repair a crack or other defect in an existing paved surface.

Paving mats are usually heavier in construction than roofing mats. For example, a paving mat may have a weight of at least about 2.5 lbs/csf (0.12 kg/$M^2$), whereas roofing mats are usually lighter in weight. Also, roofing mats are usually saturated and coated with asphalt prior to use, whereas paving mats are not.

The paving mat is a fibrous mat having any structure suitable for providing the characteristics of the invention, such as a non-woven, woven or other structure. The fibrous mat includes a fibrous matrix comprising a mixture of mineral fibers and polymer fibers.

In some embodiments, the paving mat is made with a relatively high proportion of mineral fibers and a relatively low proportion of polymer fibers. The relatively high mineral fiber content helps to improve the tensile strength of the paving mat. At the same time, the paving mat retains excellent handling properties (flexibility).

For example, the fibrous matrix may include the mineral fibers in an amount within a range of from 61 wt % to about 85 wt % (by weight of the matrix), typically from about 65 wt % to about 80 wt %, and in one embodiment about 70%. For example, the polymer fibers may be included in an amount within a range of from about 15 wt % to 39 wt %, typically from about 20 wt % to about 35 wt %, and in one embodiment about 30%. Also in one embodiment, the weight ratio of mineral fibers to polymer fibers is within a range of from about 65/35 to about 85/15.

In some embodiments, the fibrous mat includes a mixture of polymer fibers, first mineral fibers having a first median length, and second mineral fibers having a second median length that is different from the first median length. The first and second mineral fibers can have any lengths suitable for providing the characteristics of the invention. In some embodiments, the median length of the first fibers is at least about 0.25 inch (0.635 cm) greater than the median length of the second fibers, typically at least about 0.4 inch (1.016 cm) greater, and in a particular embodiment about 0.5 inch (1.27 cm) greater. In some embodiments, the median length of the first fibers is within a range of from about 0.75 inch (1.905 cm) to about 1.75 inches (4.445 cm), and typically from about 1 inch (2.54 cm) to about 1.5 inches (3.81 cm); and the median length of the second fibers is within a range of from about 0.25 inch (0.635 cm) to about 1.25 inches (3.175 cm), and typically from about 0.5 inch (1.27 cm) to about 1 inch (2.54 cm).

In the embodiment with different length mineral fibers, the polymer fibers and the mineral fibers can be included in any suitable amounts in the fibrous matrix of the paving mat. In some embodiments, the fibrous matrix includes the polymer fibers in an amount within a range of from about 1 wt % to about 40 wt %, typically from about 15 wt % to about 25 wt %, and more particularly about 20%. In some embodiments, the fibrous matrix includes the first mineral fibers in an amount within a range of from about 30 wt % to about 95 wt %, typically from about 50 wt % to about 70 wt %, and more particularly about 60%. Also, in some embodiments, the fibrous matrix includes the second mineral fibers in an amount within a range of from about 5 wt % to about 35 wt %, typically from about 15 wt % to about 25 wt %, and more particularly about 20%.

Any suitable mineral fibers can be used to produce the fibrous mat. Some examples of suitable mineral fibers for producing the mat include fibers of a heat-softenable mineral material, such as glass, rock, slag or basalt. As used herein, "mineral fibers" can also include carbon fibers, and metal fibers such as fibers made from or coated with aluminum, copper, silver, iron or chromium, and may include metallicized polymeric fibers. Such fibers may be modified to provide desired electromagnetic properties, such as by the addition of Al, Cu, Ag, Fe, Cr or other conductive metals or metalicized polymers.

Preferably, the mineral fibers are glass fibers. Any suitable process can be used to produce the glass fibers. One such process is known as a rotary process, in which molten glass is placed into a rotating spinner which has orifices in the perimeter, wherein glass flows out the orifices to produce a downwardly falling stream of fibers which are collected on a conveyor. A second fiber forming process is a continuous process in which glass fibers are mechanically pulled from the orificed bottom wall of a feeder or bushing containing molten glass. Substantially contemporaneous with forming, the glass fibers are brought into contact with an applicator wherein a size is applied to the fibers. The sized glass fibers are then chopped to a specified length and packaged. Glass fibers made by these processes are commercially available from Owens Corning, Toledo, Ohio.

The glass fibers can have any suitable composition. Different types of glass fibers are well known to those skilled in the art. For example, the fibers may be M glass, K glass, E glass, E CR glass, C glass fibers, A glass, or any mixtures thereof. The glass fibers may have any suitable diameter, for example, a diameter within a range of from about 6 microns to about 25 microns, typically from about 10 microns to about 20 microns.

In one embodiment, one or both of the first and second glass fibers are Advantex® glass fibers manufactured by Owens Coming. These fibers are made from a glass which is essentially boron free, and which in one embodiment consists essentially of 59.0 to 62.0 weight percent $SiO_2$, 20.0 to 24.0 weight percent CaO, 12.0 to 15.0 weight percent $Al_2O_3$, 1.0 to 4.0 weight percent MgO, 0.0 to 0.5 weight percent $F_2$, 0.1 to 2.0 weight percent $Na_2O$, 0.0 to 0.9 weight percent $TiO_2$, 0.0 to 0.5 weight percent $Fe_2O_3$, 0.0 to 2.0 weight percent $K_2O$, and 0.0 to 0.5 weight percent $SO_3$, wherein the composition has (i) a viscosity of 1000 poise at a forming temperature of from 2100.degree. F. (1149.degree. C.) to 2500.degree. F. (1371.degree. C.) and (ii) a liquidus temperature at least 100.degree. F. (38.degree. C.) below the forming temperature. The Advantex® glass fibers are described in more detail in U.S. Pat. No. 5,789,329, issued Aug. 4, 1998, which is incorporated by reference herein.

Any suitable polymer fibers, or mixtures of different polymer fibers, can be used to produce the fibrous mat. Suitable polymer fibers can be formed from a fibrous or fiberizable material prepared from natural organic polymers, synthetic organic polymers or inorganic substances. Natural organic polymers include regenerated or derivative organic polymers. For example, the natural fibers can include cellulosic fibers such as flax, jute or wood pulp. Synthetic polymers include, but are not limited to, polyesters such as polyethylene terephthalate (PET), polyamides (for example, nylons), polypropylenes, polyphenylenes such as polyphenylene sulfide (PPS), polyolefins, polyurethanes, polycarbonates, polystyrenes, acrylics, vinyl polymers, and derivatives and mixtures thereof. A specific embodiment of the mat includes PET fibers.

The polymer fibers used to produce the fibrous mat can have any suitable melting point. In some embodiments, the polymer fibers have a melting point greater than about 320° F. (160° C.), at least about 325° F. (163° C.), at least about 330° F. (166° C.), or at least about 340° F. (171° C.).

The polymer fibers can have any suitable length. In some embodiments, the median length of the polymer fibers is within a range of from about 0.25 inch (0.635 cm) to about 2 inches (5.08 cm), such as from about 0.25 inch (0.635 cm) to about 1.25 inches (3.175 cm), typically from about 0.5 inch (1.27 cm) to about 1 inch (2.54 cm).

The polymer fibers can have any suitable diameter. In some embodiments, the polymer fibers have a denier within a range between about 1.5 dtex and about 12 dtex, and typically from about 5 dtex to about 8 dtex.

The fibrous matrix of the paving mat is usually bonded together by a binder or a mixture of different binders. However, some embodiments of the paving mat can be made without a binder using any of the methods known in the art, for example, by needling, hydroentanglement or air entanglement.

Any suitable binder(s) can be used in the fibrous mat. In one embodiment, the fibrous matrix of the mat is bonded together by a mixture of different binders. The binder mixture can include any binders that produce a mat having the characteristics of the invention. In one embodiment, the binders each have a melting point greater than about 160° C. In a particular embodiment, the binder comprises a mixture of an acrylic resin and a formaldehyde resin. In another embodiment, the binder further comprises a styrene-butadiene copolymer latex in addition to the acrylic resin and formaldehyde resin.

Any suitable type of acrylic resin, or a mixture of different acrylic resins, can be used in the binder. The acrylic resin may contain a monomer such as alkyl acrylate, alkyl methacrylate (wherein alkyl may be methyl, ethyl, n-propyl, isopropyl, n-butyl, isobutyl, t-butyl, 2-ethylhexyl, cyclohexyl, phenyl, benzyl, phenylethyl and the like), hydroxy-containing monomer (e.g., 2-hydroxyethyl acrylate, 2-hydroxyethyl methacrylate, 2-hydroxypropyl methacrylate and the like), amide-containing monomer (e.g., acrylamide, methacrylamide, N-methylmethacrylamide, N-methylacrylamide, N-methylolacrylamide, N-methylolmethacrylamide, N,N'-dimethylolacrylamide, N-methoxymethylacrylamide, N-methoxymethylmethacrylamide, N-phenylacrylamide and the like), amino-containing monomer (e.g., N,N'-diethylaminoethyl acrylate, N,N'-diethylaminoethyl methacrylate and the like), epoxy-containing monomers (e.g., glycidyl acrylate, glycidyl methacrylate and the like), monomer containing carboxyl group or a salt thereof (e.g., acrylic acid, methacrylic acid and salt thereof (e.g., sodium salt, potassium salt, ammonium salt) and the like) and the like. These may be used together with other kinds of monomers. Other kinds of monomers include epoxy group-containing monomers (e.g., allylglycidyl ether and the like), monomers containing sulfonic acid group or a salt thereof (e.g., styrenesulfonic acid and salt thereof (e.g., sodium salt, potassium salt, ammonium salt and the like) and the like), monomers containing carboxyl group or a salt thereof (e.g., chrotonic acid, itaconic acid, maleic acid, fumaric acid and salts thereof (e.g., sodium salt, potassium salt, ammonium salt and the like) and the like), allylisocyanate, styrene, alkyl maleic monoesters, alkyl fumaric monoesters, acrylonitrile, methacrylonitrile, alkyl itaconic monoesters, and the like. In addition, vinyl compounds may also be suitable. Some specific nonlimiting examples of acrylic copolymers include methylmethacrylate/butyl acrylate, styrene acrylate, vinyl acetate/ethylene, and vinyl chloride/ethylene.

An example of an acrylic resin that may be suitable for use in the binder is the GL618 acrylic copolymer manufactured by Rohm and Haas, Philadelphia, Pa., which has a glass transition temperature of about 35° C. Other examples include the Hycar® series of resins manufactured by Noveon Inc., Cleveland, Ohio, such as Hycar 26138 or Hycar 26288. These are carboxy-modified acrylic resins. In one embodiment, a carboxy-modified acrylic resin is used as the sole binder in the mat. This binder has been discovered to provide a mat having a high tensile strength with good flexibility.

Any suitable type of formaldehyde resin, or a mixture of different formaldehyde resins, can be used in the binder. For example, the formaldehyde resin may be a urea formaldehyde resin, a melamine formaldehyde resin, or a phenol formaldehyde resin. In a particular embodiment, a urea formaldehyde resin is used in the binder. Urea formaldehyde resins are well known and widely commercially available. Examples of commercially available urea formaldehyde resins include the Casco-Resin® series of resins such as Casco-Resin C-802B and Casco-Resin 520HT, which are available from Hexion Specialty Chemicals, Columbus, Ohio, the GP series of resins such as GP-2928 and GP-2981 which are available from Georgia Pacific Resins, Inc., Atlanta, Ga., and the urea formaldehyde resins sold by Neste Resins Corporation, Moncure, N.C.

Any suitable type of styrene-butadiene copolymer latex, or a mixture of different latexes, can be used in the binder. The copolymer can have different ratios of styrene monomer to butadiene monomer. A number of different styrene-butadiene copolymer latexes are commercially available. An example of a suitable latex is a DL 490NA styrene-butadiene copolymer latex manufactured by Dow Reichhold Specialty Latex, Research Triangle Park, N.C.

In one embodiment, the fibrous composition of the mat allows the amount of binder to be decreased while still achieving desired air permeability properties of the mat. For example, in some embodiments the paving mat has an air permeability within a range of from about 350 to about 650 CuFt/Min/SqFt (about 921 to about 1710 liters/min/$m^2$), and typically from about 380 to about 570 CuFt/Min/SqFt (about 1000 to about 1500 liters/min/$m^2$). The air permeability of the mat can be measured by any suitable method, for example, by ASTM D 737.

Any suitable amount of the binder mixture can be used in the mat. In some embodiments, the binder mixture is included in an amount within a range of from about 17% to about 30% by weight of the mat. In one embodiment, the fibrous composition of the mat allows the amount of binder to be decreased while still achieving the desired mat properties. For example, in one embodiment the amount of binder is decreased by at least about 2 wt % compared to the same paving mat in which the second mineral fibers are replaced by an equal amount of the polymer fibers. In one embodiment, the amount of binder is within a range of from about 15% to 20% by weight of the mat, and more particularly about 18%.

If a mixture of an acrylic resin and a formaldehyde resin is used in a binder mixture, they can be included in any suitable amounts. In one embodiment, the binder mixture comprises the acrylic resin in an amount within a range of from about 50 wt % to about 90 wt %, typically from about 60 wt % to about 80 wt %, and the formaldehyde resin in an amount within a range of from about 10 wt % to about 50 wt %, typically from about 20 wt % to about 40 wt %. Also, if a styrene-butadiene copolymer latex is used in the binder along with the acrylic resin and the formaldehyde resin, it can be used in any suitable amount. In one embodiment, the binder mixture comprises the acrylic resin in an amount within a range of from about 50 wt % to about 90 wt %, typically from about 60 wt % to about 80 wt %, the formaldehyde resin in an amount within a range of from about 9 wt % to about 45 wt %, typically from about 18 wt % to about 36 wt %, and the styrene-butadiene copolymer latex in an amount within a range of from about 1 wt % to about 5 wt %, typically from about 2 wt % to about 4 wt %. The weight percentages of binder described herein are on a dry weight basis.

After the binder is applied to the fibrous matrix, the binder is cured to bond together the fibrous matrix. Typically, any suitable curing oven or any other suitable heating apparatus is used to cure the binder mixture. In some embodiments, the binder mixture is cured at a temperature not greater than about 500° F. (260° C.), typically within a range of from about 350° F. (177° C.) to about 450° F. (232° C.), and more particularly preferably from about 400° F. (204° C.) to about 450° F. (232° C.).

In some embodiments, the paving mat (for example, a mat containing 70 wt % of the mineral fibers and 30 wt % of the polymer fibers) has an average tensile strength in the machine direction which is increased by at least about 7%, typically by at least about 10%, compared to the same mat that contains a lower mineral fiber content (for example, a mat containing 60 wt % of the mineral fibers and 40 wt % of the polymer fibers). As well known to persons skilled in the art, the machine direction of the mat is the direction of travel of the mat on the production line, and the cross direction is transverse to the machine direction. In a finished mat, the machine direction can often be determined by examining the orientation of the fibers because the majority of the fibers tend to align parallel to the machine direction. Also in some embodiments, the paving mat has an average tensile strength in the machine direction of at least about 70 $lb_f$ (311.4 N), typically from about 70 $lb_f$ (311.4 N) to about 110 $lb_f$ (489.4 N), and an average tensile strength in the cross direction of at least about 55 $lb_f$(244.7 N), typically from about 55 $lb_f$(244.7 N) to about 70 $lb_f$(311.4 N). The tensile strength can be measured by any suitable method, for example, by ASTM D 5035-95.

The handling properties (flexibility) of the paving mat can be characterized by any suitable method, for example, by measuring the Taber stiffness of the mat according to ASTM D 5342-97. In some embodiments, the mat has a stiffness in the machine direction within a range of from about 65 g-cm to about 110 g-cm, typically from about 65 g-cm to about 95 g-cm, and a stiffness in the cross direction within a range of from about 40 g-cm to about 80 g-cm, typically from about 50 g-cm to about 75 g-cm. In one embodiment, the paving mat (for example, a mat containing 70 wt % of the mineral fibers and 30 wt % of the polymer fibers) has a stiffness in the machine direction which is not increased by more than about 2% compared to the same mat that contains a lower mineral fiber content (for example, a mat containing 60 wt % of the mineral fibers and 40 wt % of the polymer fibers), and preferably the stiffness is substantially the same compared to that mat.

In one embodiment, the paving mat has a desired load-elongation behavior: when the mat is subject to tensile stress, it achieves at least 90% of its ultimate (breaking) load at an elongation not greater than 5% of the specimen length in the direction of applied stress. Although any suitable test method can be used, typically the load-elongation is tested on a 2-inch (5.08 cm) wide specimen with a 7-inch (17.78 cm) length between the jaws and a rate of extension of 2 inches (5.08 cm)/minute, at room temperature. This test method is described in ASTM D 5035.

Also in one embodiment, the paving mat resists shrinkage when exposed to hot paving material. The resistance to shrinkage may be measured as follows: when a 4 ounce (113.4 gram) sample of the mat is held in an oven at 325° F. (163° C.) for one hour, the mat shrinks no more than about 10% from its original area, preferably no more than about 5%, and more preferably the mat has substantially no loss of area.

The paving mat can be produced by any suitable method. Some examples of well-known methods of producing non-woven fibrous mats are the wet-laid process, the dry-laid process, and the cylinder forming process. In the wet-laid process, a water slurry is provided into which the fibers are dispersed. The water slurry may contain surfactants, viscosity modifiers, defoaming agents, or other chemical agents. Chopped fibers are then introduced into the slurry and agitated such that the fibers become dispersed. The slurry containing the fibers is then deposited onto a moving screen, and a substantial portion of the water is removed to form a mat. A binder is then applied by spraying or any other suitable application process. The resulting mat is heated to dry it and to cure the binder. The resulting non-woven mat consists of an assembly of substantially dispersed individual fibers. In the dry-laid process, fibers are chopped and air blown onto a conveyor, and a binder is then applied to form the mat.

Figure 8:
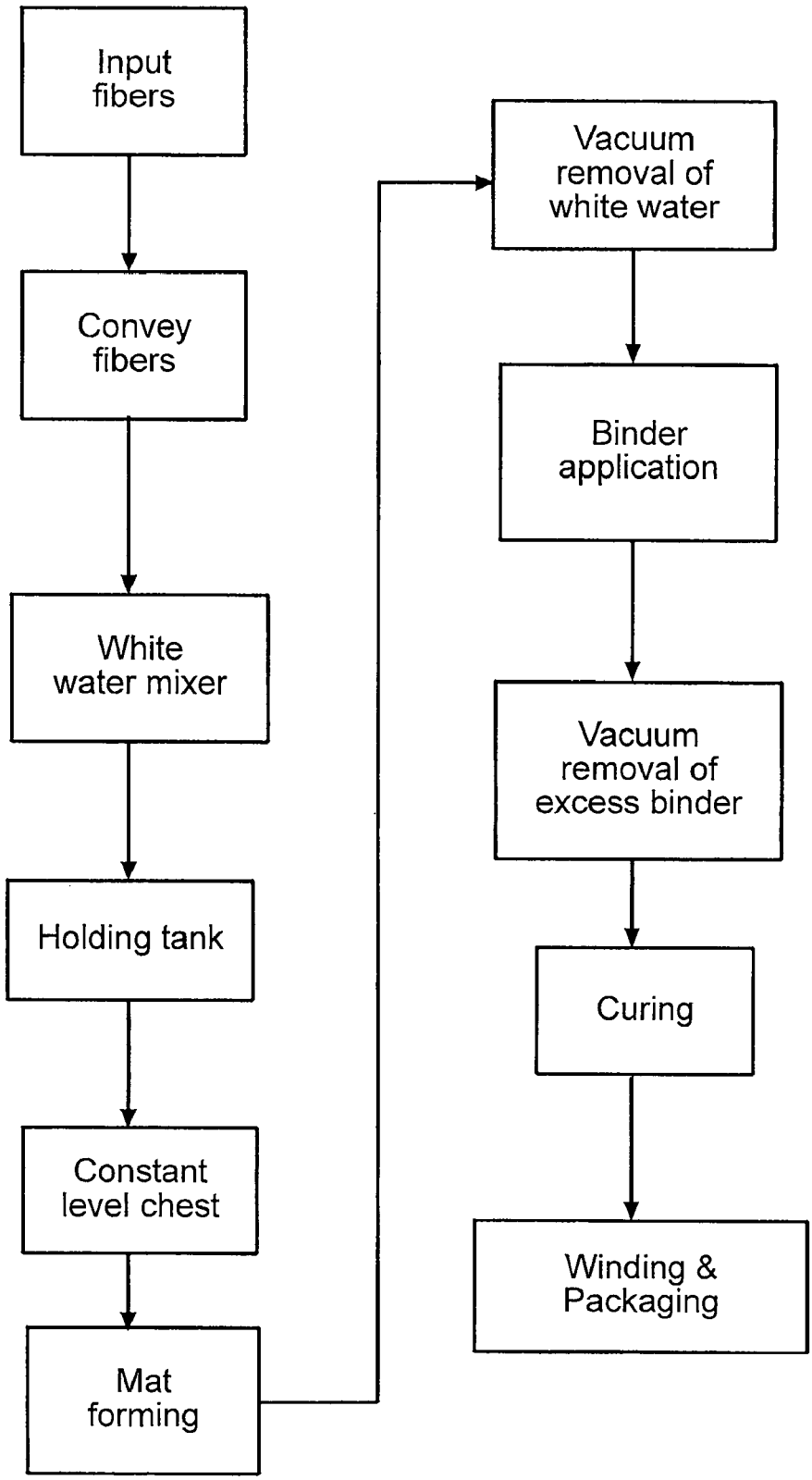
FIG. 8 is a process map of a method of producing a paving mat according to the invention.

FIG. 8 illustrates one example of a method for producing the paving mat, but it is recognized that the paving mat can be produced by many alternate ways. In the example shown, the mixture of mineral fibers and polymer fibers are conveyed to a white water mixer which contains a water slurry. The fibers are agitated in the slurry such that they become dispersed. The slurry containing the fibers is then conveyed to a holding tank and then to a constant level chest. The slurry is then deposited onto a moving screen to form a mat. A substantial portion of the water is removed by use of vacuum. A binder is then applied. Excess binder is removed by use of vacuum. The mat is conveyed to a curing oven where it is dried and the binder is cured. The finished mat is conveyed for winding and packaging.

In one embodiment, the composition of the paving mat lowers the scrap rate of the method of production when it is carried out on an industrial scale. For example, the scrap rate may be reduced to less than about 10%, or typically less than about 7%.

Referring to the drawings, FIG. 1 shows a paved surface 10 which is improved using a mat 14 according to the invention. The mat 14 can be applied on the paved surface 10 in any suitable manner. In one method, described below, a tack layer of liquefied asphalt 12 is first applied onto the paved surface 10, and then the mat 14 is applied onto the tack layer. However, other methods (not shown) of applying the mat can also be used. For example, a layer of adhesive can be applied to the paved surface and then the mat applied over the adhesive. Alternatively, a peel and stick adhesive can be applied to the mat and then the mat applied to the paved surface. In some methods, the mat may be sufficiently tacky for application to the paved surface without the use of a tack layer or adhesive. Alternatively, the mat may be laid and the liquefied asphalt may be applied on the top of the mat to saturate the mat.

In the embodiment shown in FIG. 1, a tack layer of liquefied asphalt 12 is initially applied onto the paved surface 10. The liquefied asphalt 12 can be any type of bituminous material which is fluid at the time of application but which is able to firm up after application. For example, the liquefied asphalt can be a molten asphalt such as asphalt heated to a temperature above about 250° F. (121° C.), an asphalt emulsion (asphalt dispersed in water with an emulsifier), or an asphalt cutback (asphalt diluted with a solvent to make the asphalt fluid). The liquefied asphalt can also include polymer-modified asphalt and asphalt containing a filler.

The layer of liquefied asphalt 12 can be applied in any amount which is suitable for penetrating and soaking the mat 14. Preferably, the liquefied asphalt is applied at a rate within a range of from about 0.1 gallon/square yard (0.32 liter/square meter) to about 0.5 gallon/square yard (1.58 liter/square meter), the optimum rate depending on the weight of the mat. The liquefied asphalt can be applied by any suitable method, such as by spraying it as a layer or by pouring and spreading it into a layer.

A mat 14 according to the invention is applied over the liquefied asphalt 12, while the liquefied asphalt is still in the fluid condition. In the embodiment shown in FIG. 1, the mat 14 is a one-layer mat. The mat 14 is sufficiently porous such that the liquefied asphalt penetrates and soaks the mat. In the embodiment shown, the layer of liquefied asphalt 12 includes a bottom portion 16 below the mat 14 and a top portion 18 which saturates the mat. However, the liquefied asphalt could also be located entirely inside the mat after it is applied. Preferably, the mat can absorb at least about 0.1 gallon/square yard (0.32 liter/square meter) of the liquefied asphalt.

A sufficient amount of liquefied asphalt 12 is applied, and the mat 14 soaks up enough liquefied asphalt, to form a strong bond with the paved surface 10 and with the layer of paving material 20, described below. The mat preferably forms a water barrier that prevents water from penetrating into the paved surface from above. Preferably, the mat is substantially completely saturated with the liquefied asphalt, such that the liquefied asphalt penetrates from a bottom surface 22 to a top surface 24 of the mat 14.

Figure 2:
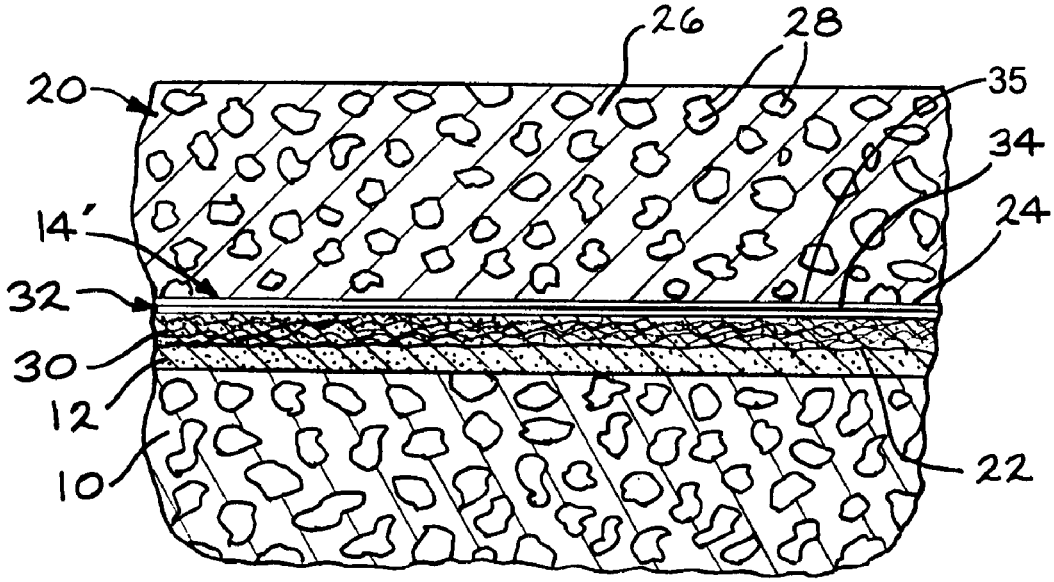
FIG. 2 is a cross-sectional view in elevation of a paved surface including a two-layer paving mat according to the invention.

FIG. 2 illustrates a paved surface including a two-layer mat 14' according to the invention. The mat 14' includes a first layer 30 and a second layer 32. The first layer 30 is a non-woven or woven fibrous mat made from mineral fibers, polymer fibers, natural fibers, or mixtures thereof. Preferably, the first layer 30 is a non-woven fibrous mat as described above in relation to the one-layer mat 14 shown in FIG. 1.

Figure 3:
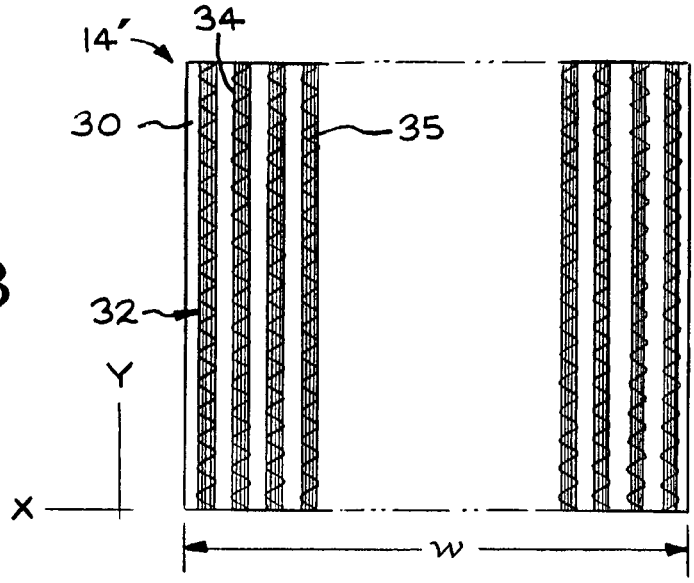
FIG. 3 is a plan view of a first embodiment of the two-layer paving mat illustrated in FIG. 2 showing a second layer of continuous strands of glass fiber.

In a first embodiment, shown in FIG. 3, the first layer 30 of the mat 14' is made of glass fibers, and has a width w. Such a glass fiber mat is thermally stable, and does not melt and/or shrink when it is exposed to hot paving material. At the levels of strain encountered in the movement of pavements, the glass fiber mat comprising the first layer 30 carries much higher tensile loads than the polypropylene mats typically used. Preferably, the glass fiber mat has a basis weight within a range of from about 0.5 to about 10 pounds per hundred square feet (about 0.02 kg/m$^2$ to about 0.42 kg/m$^2$), and more preferably from about 1 to about 5 pounds per hundred square feet (about 0.04 kg/m$^2$ to about 0.21 kg/m$^2$).

As shown in FIG. 3, the second layer 32 includes a plurality of continuous strands 34 of glass fibers disposed on a surface of the first layer 30. The strands 34 can be oriented in any desired direction relative to the first layer 30, and relative to one another. In the embodiment shown in FIG. 3, the strands 34 are oriented along the Y direction, and are substantially parallel to one another. In another embodiment (not shown), in addition to the strands oriented along the Y direction, the second layer also includes a plurality of strands oriented along the X direction.

Adjacent parallel strands 34 can be spaced at any desired distance relative to one another. Preferably, the strands 34 are spaced within the range of about 0.5 to about 12 strands per inch of width w (19.7 to 472 strands/meter of width w) of the first layer 30. More preferably, the strands 34 are spaced at about 2.0 strands per inch of width w (78.8 strands/meter of width w) of the first layer 30.

Each bundle 34 can contain any desired amount of filaments of glass fibers. The strands 34 preferably have a linear density within the range of from about 100 to about 1000 yards per pound (241 to 2411 meters/kilogram) of glass. More preferably, the strands 34 have a linear density within the range of from about 200 to about 450 yards per pound (482 to 1085 meters/kilogram) of glass. Additionally, the second layer 32 preferably weighs within the range of from about 0.5 to about 15 ounces per square yard (17 to 512 grams/square meter) of mat 14'. More preferably, the second layer 32 weighs within the range of from about 4.5 to about 6.5 ounces per square yard (153 to 220 grams/square meter) of mat 14'.

The strands 34 comprising the second layer 32 can be attached to the first layer 30 by any desired method. Knitting, as shown in FIG. 3, is a preferred method of attaching the strands 34 to the first layer 30. As used herein, knitting is defined as a method of attaching by interlacing yarn or thread 35 in a series of connected loops with needles. The strands 34 can also be attached to the first layer 30 by other methods, such as, for example, sewing, needling, heat treating, adhering with an adhesive, or any combination thereof. The thread 35 can be any desired natural or synthetic material. Preferably the thread 35 is synthetic. More preferably, the thread 35 is polyester or nylon because of the relatively high melting temperatures of both polyester and nylon. The thread preferably is made from a polymer having a melting point of at least about 350° F. (177° C.), more preferably at least about 400° F. (204° C.).

Figure 4:
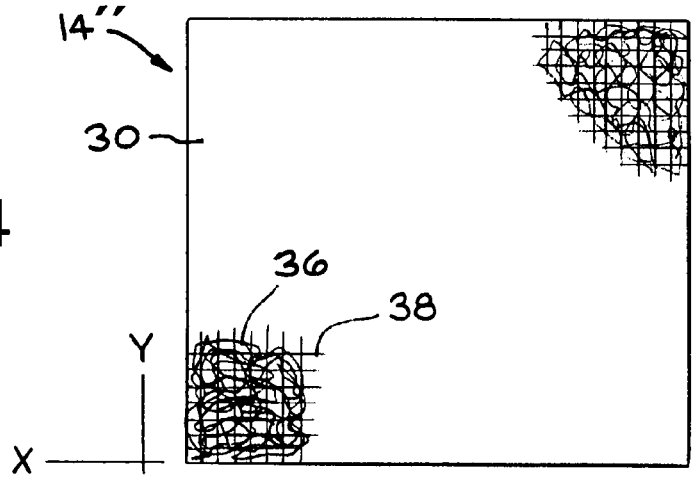
FIG. 4 is a plan view of a second embodiment of the two-layer paving mat illustrated in FIG. 2 showing a second layer of randomly-oriented continuous-strand glass fiber mat.

A second embodiment of the two-layer mat is generally shown at 14" in FIG. 4. The mat 14" includes the first layer 30, and a second layer 36. The second layer 36 is formed from a randomly-oriented continuous strand of glass fiber applied to a surface of the first layer 30 by any conventional method. The layer 36 formed from the continuous strand of glass fiber is commonly known as a continuous filament mat (CFM). The second layer 36 can have any desired weight. Preferably, the second layer 36 weighs within the range of from about 4.5 to about 45 ounces per square yard (154 to 1535 grams/square meter) of mat 14". More preferably, the second layer 36 weighs within the range of from about 9.0 to about 18 ounces per square yard (307 to 614 grams/square meter) of mat 14".

The second layer 36 can be attached to the first layer 30 by any desired method. Knitting is a preferred method of attaching the second layer 36 to the first layer 30, as described above for attaching the second layer 32 to the first layer 30. As shown in FIG. 4, threads 38 attach the second layer 36 to the first layer 30 in a series of connected loops.

Figure 5:
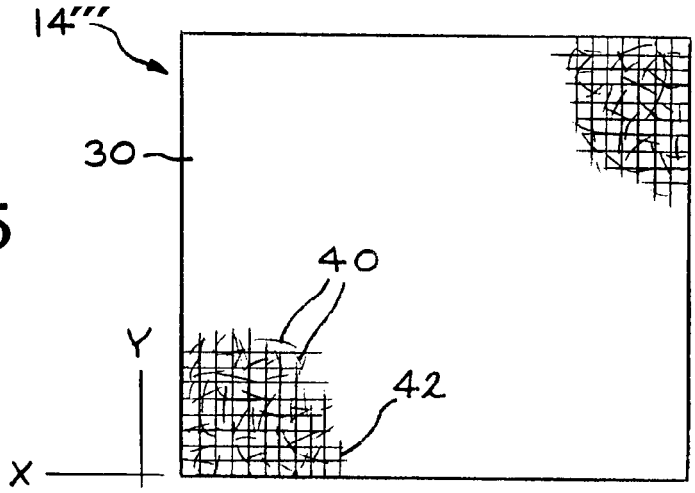
FIG. 5 is a plan view of a third embodiment of the two-layer paving mat illustrated in FIG. 2 showing a second layer of randomly-oriented chopped strands of glass fiber.

A third embodiment of the two-layer mat is generally shown at 14'" in FIG. 5. The mat 14'" includes the first layer 30, and a second layer 40. The second layer 40 is formed from randomly-oriented chopped strands of glass fiber applied to a surface of the first layer 30 by any conventional method. The random orientation of the chopped strands of the layer 40 provide improved strength to the mat 14''' in a first, x, dimension and a second, y, dimension. The second layer 40 can include chopped strands of any desired length. Preferably, the chopped strands have a length within the range of from about 0.5 to about 8.0 inches (0.013 to 0.20 meters). More preferably, the chopped stands have a length within the range of from about 2.0 to about 4.0 inches (0.05 to 0.1 meters). Most preferably, the chopped stands have a length of about 2.0 inches (0.05 meters).

The second layer 40 can have any desired weight. Preferably, the second layer 40 has a weight within the range of from about 0.5 to about 15 ounces per square yard (17 to 512 grams/square meter) of mat 14'''. More preferably, the second layer 40 weighs within the range of from about 5.0 to about 8.0 ounces per square yard (171 to 273 grams/square meter) of mat 14'''. The second layer 40 can be attached to the first layer 30 by any desired method. Knitting is a preferred method of attaching the second layer 40 to the first layer 30, as described above for attaching the second layer 32 and 36 to the first layer 30. As shown in FIG. 5, threads 42 attach the second layer 40 to the first layer 30 in a series of connected loops.

The second layer can also be a woven mat or grid (not shown) attached to the first layer, where the first layer is a non-woven mat as described above. In a preferred embodiment, the second layer is a woven glass fiber mat or grid, and the first layer is a non-woven mat made from glass and polymer fibers, most preferably polyethylene fibers. The woven mat or grid can be attached to the non-woven mat in any suitable manner, for example, by stitching or gluing. The grid itself could be stitched or glued together and then attached to the mat, or formed in a series of operations onto the mat.

The one-layer mat 14 and the two-layer mat 14', 14'' and 14''' can be wrapped in a continuous roll, although a continuous roll is not required. Preferably, such a continuous roll has a width within a range of from about 5 feet (1.52 meters) to about 20 feet (6.1 meters). The continuous roll may also have any desired width. The mat is applied by unrolling the mat from the roll onto the tack layer or directly onto the paved surface.

Referring again to the embodiment shown in FIG. 1, the liquefied asphalt is allowed to become firm, or at least partially solidify, at some time after the application of the mat. Usually, the liquefied asphalt is allowed to become firm before the application of the paving material described below. For example, molten asphalt can be allowed to become firm by cooling, asphalt emulsion can be allowed to become firm by evaporation of water, and cutback asphalt can be allowed to become firm by evaporation of solvent. The open porosity of the one-layer mat 14, and of the first layer 30 of the two-layer mat 14', 14'' and 14''', facilitates the evaporation of water or solvent.

A layer of paving material 20 is applied over the mat. The paving material 20 can be any material suitable for providing a top surface layer of a paved surface, such as an asphalt paving material, typically a mixture of asphalt 26 and aggregate 28, or a concrete paving material. The paving material is usually applied in a heated condition, and then allowed to cool. When the heated paving material is applied over the mat the heat of the mix partially liquefies the asphalt in the reinforcement layer, drawing it up into the mat, and forming a monolithic waterproof bond with the overlying pavement layer. It is during this heating step (that is unavoidable when placing an asphalt paving mixture over the mat) that damage from melting and shrinking can occur with polypropylene mats.

When the paved surface is completed, the penetration of the mat 14 by the liquefied asphalt 12 (now at least partially solidified) forms a strong bond between the mat, the asphalt, the paved surface, and the layer of paving material. This creates a strong, monolithic paved surface structure that is very resistant to damage. The high tensile and mechanical strength of the mat may provide mechanical reinforcement to the paved surface. Additionally, the penetration of the mat by the asphalt may form a water barrier or waterproof membrane that prevents water from penetrating into the paved surface from above and causing damage.

In another embodiment (not illustrated), a non-paved surface is paved by applying the liquefied asphalt on a prepared unpaved surface, applying the mat over the liquefied asphalt and the prepared unpaved surface, and applying the paving material over the mat. In some embodiments, the mat can be applied without first applying the liquefied asphalt.

Figure 6:
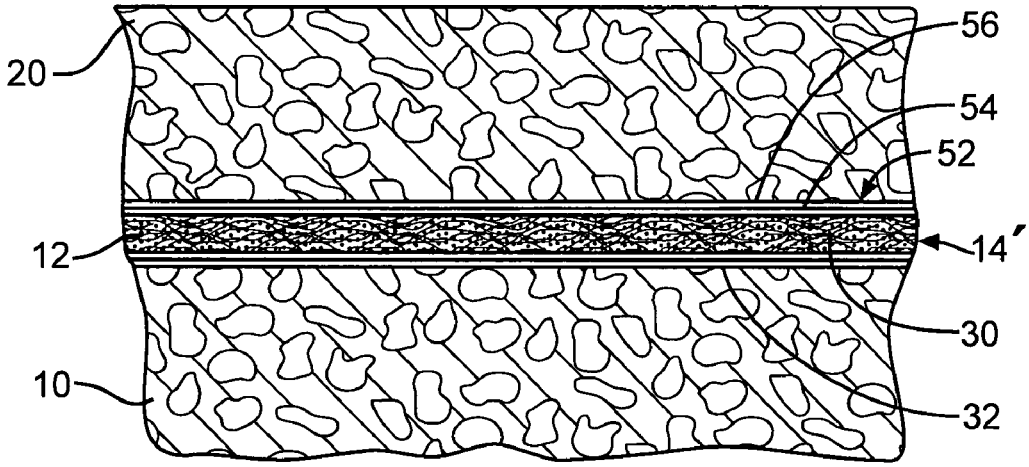
FIG. 6 is a cross-sectional view in elevation of a paved surface including a paving mat having a nonstick layer according to the invention.

In a further embodiment of the invention, a nonstick layer is applied to one of the mats described above. As shown in FIG. 6, the nonstick layer 52 includes a polymer layer 54, and a nonstick coating 56 on the upper surface of the polymer layer. The nonstick layer resists sticking to the tires of paving construction equipment that have been coated with asphalt tack during the paving operation, and it allows the bonding of the paved surface 10, the mat 14', and the upper layer 20 of paving material. To accomplish this, the nonstick coating and the polymer layer resist melting at typical tack layer 12 temperatures. However, once the upper layer 20 of paving material is applied, the higher temperature of the upper layer causes the melting of the nonstick layer 52, thereby allowing a firm bond to be formed between the paved surface 10, the mat 14', and the upper layer 20 of paving material. (For illustration purposes, the nonstick layer 52 is shown in FIG. 6 prior to melting.)

The polymer layer of the nonstick layer consists of any type of polymer or mixture of polymers having the desired melting properties and solubility characteristics in asphalt. Preferably, the polymer has a melting point between about 200° F. (93° C.) and about 300° F. (149° C.), and more preferably between about 225° F. (107° C.) and about 250° F. (121° C.). Some examples of polymers that may be suitable include polyethylene, polypropylene, or a combination of polymers such as thermoplastic polyolefins (TPO's).

Any suitable non-stick coating material can be used on the upper surface of the polymer layer, such as Teflon® or silicone.

The nonstick layer is thick enough to resist damage from the paving operation, but thin enough to melt into the upper layer of paving material and not impede the function of the mat to which it is attached. Preferably, the overall thickness of the nonstick layer is in the range of about 0.005 inch (0.127 millimeter) to about 0.050 inch (1.27 millimeter), and more preferably about 0.015 inch (0.381 millimeter) to about 0.020 inch (0.508 millimeter). The thickness of the nonstick coating portion of the nonstick layer is typically about 0.001 inch (0.025 millimeter).

The nonstick layer can be in any suitable form, such as a sheet or strips. The nonstick layer can be adhered to the mat by any suitable method, such as by gluing, sewing, knitting, or other forms of adhesion and attachment.

As mentioned above, the mat of the invention can be used in the construction of a new paved surface, in the rejuvenation of an existing paved surface, or to repair cracks, potholes or other defects in an existing paved surface. When the defect is a crack in a paved surface, the mat with or without a tack layer may be applied over the crack without initial preparation of the crack, or alternatively the crack may be filled with an appropriate crack filler such as those meeting the requirements of ASTM D-3405 or D-1190 or other suitable material. When the defect is a pothole in the paved surface, typically the pothole is initially filled with a material conventionally used for filling potholes, such as an asphalt paving material. Then the mat with or without a tack layer is applied over the filled pothole. Badly broken or rough pavement may require milling or placement of a leveling course before application of the mat. Finally, a layer of paving material is applied over the mat and the defect. When the repair is completed, the mat forms a strong bond with the paved surface and holds the paved surface around the defect together. The mat may prevent water from penetrating into the defect from above and causing further damage.

Figure 7:
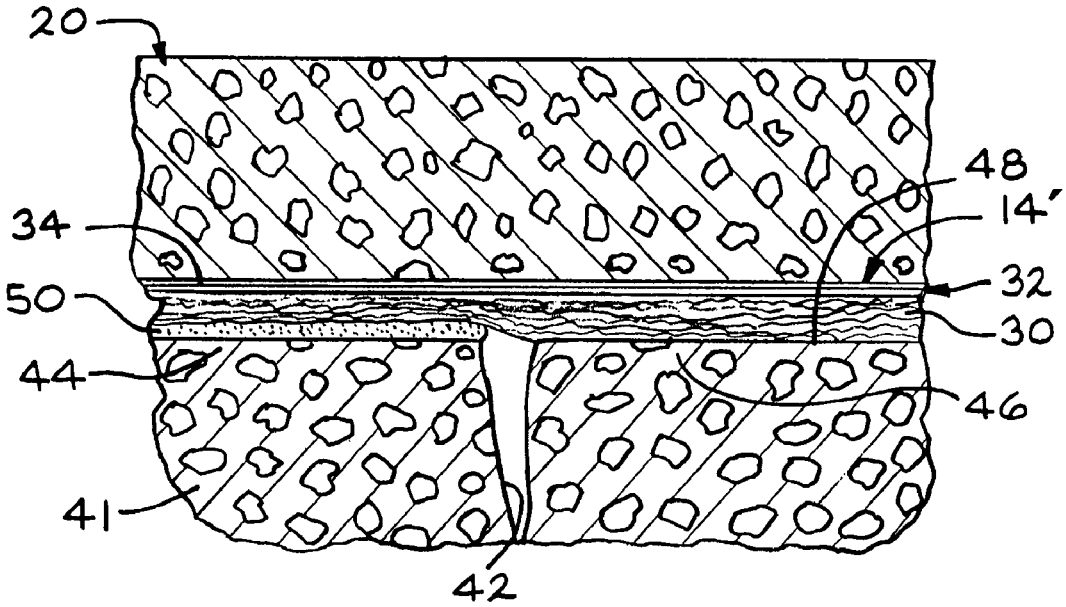
FIG. 7 is a cross-sectional view in elevation of a paved surface having a crack which is repaired using a two-layer paving mat according to the invention.

In another embodiment, the invention relates to a particular method of repairing a crack in a paved surface. FIG. 7 shows a paved surface 41 having a crack 42 which is repaired according to this method. The paved surface 41 includes a first surface portion 44 on one side of the crack (the left side as viewed in FIG. 7), and a second surface portion 46 on the opposite side of the crack (the right side as viewed in FIG. 7). In the illustrated embodiment, the first surface portion is adjacent a first longitudinal side of the crack and the second surface portion is adjacent a second longitudinal side of the crack.

In this repair method, a desired mat is applied over the crack 42. Any type of mat may be used, such as mat 14, 14', 14" or 14'" or another suitable mat. In this repair method it is preferred that the mat is saturated with asphalt before it is applied to a road surface. As shown in FIG. 7, the mat 14' is secured to the first surface portion 44 of the paved surface 41 on the one side of the crack, but the mat is left unsecured to the second surface portion 46 of the paved surface 41 on the opposite side of the crack.

Then, a layer of paving material 20 is applied over the mat 14'. Securing the mat to the paved surface on only one side of the crack reduces the occurrence of reflective cracking by leaving a slip plane or energy dissipation area 48 between the mat 14' and the second surface portion 46 of the paved surface. The slip plane 48 is defined as the area where a bottom surface of the mat 14' contacts the paved surface 41. As the paved surface 41 surrounding the crack 42 is caused to move over time, the slip plane 48 allows the second surface portion 46 to move relative to the mat 14' without the movement of the second surface portion 46 being reflected to the newly applied layer of paving material and thereby creating a crack in the paving material.

The mat can be secured to the paved surface on one side of the crack by any suitable method. In the embodiment shown in FIG. 7, an adhesive 50 is applied to the first surface portion 44 of the paved surface 41 adjacent the crack 42 thereby adhering the mat 14' to the first surface portion 44. Any suitable adhesive can be used, such as molten asphalt or a polymeric adhesive.

In another embodiment (not shown), the adhesive is first applied to the mat, and the mat having the adhesive is then applied to the paved surface. In another embodiment (not shown), the mat is secured to the paved surface by first applying a pressure sensitive adhesive to the mat, and then pressing the mat against the paved surface. In a further embodiment (not shown), the mat is secured to the paved surface by first applying a self-activated adhesive to the mat, and applying the mat to the paved surface in a manner which activates the adhesive. For example, the self-activated adhesive may be a heat-activated adhesive which is activated when the layer of heated paving material is applied over the mat. Alternatively, the mat may comprise other known materials adhered to a single side of the crack.

The principle and mode of operation of this invention have been described in its preferred embodiments. However, it should be noted that this invention may be practiced otherwise than as specifically illustrated and described without departing from its scope. For example, while the method of the invention has been illustrated in terms of a new or rejuvenated paved surface, and repairing a crack in a paved surface, the mat can also be used for repairing other defects such as potholes in paved surfaces. The drawings show a particular type and size of mat, but other types and sizes of mat can also be used. The drawings also show particular types and amounts of liquefied asphalt and paving material, but it is recognized that other types and amounts of liquefied asphalt and paving material can be used in the invention.

What is claimed is:

1. A paving mat for use in a paved surface comprising:

a fibrous mat in the form of a paving mat, the fibrous mat including a fibrous matrix comprising a mixture of polymer fibers, first mineral fibers having a first median length, and second mineral fibers having a second median length that is different from the first median length;

wherein the mat has an average tensile strength in the machine direction of within the range of from about 70 lbf (311.4 N) to about 110 lbf (489.4 N).

2. The paving mat of claim 1 wherein the paving mat has an air permeability within a range of from about 350 to about 650 CuFt/Min/SqFt (about 921 to about 1710 liters/min/$m^2$).

3. The paving mat of claim 1 wherein the first median length is at least about 0.25 inch (0.635 cm) greater than the second median length.

4. The paving mat of claim 3 wherein the first median length is within a range of from about 0.75 inch (1.905 cm) to about 1.75 inches (4.445 cm) and the second median length is within a range of from about 0.25 inch (0.635 cm) to about 1.25 inches (3.175 cm).

5. The paving mat of claim 1 wherein the polymer fibers have a median length within a range of from about 0.25 inch (0.635 cm) to about 1.25 inches (3.175 cm).

6. The paving mat of claim 1 wherein the fibrous matrix comprises from about 1 wt % to about 40 wt % polymer fibers, from about 30 wt % to about 95 wt % first mineral fibers, and from about 5 wt % to about 35 wt % second mineral fibers.

7. The paving mat of claim 1 wherein the fibrous mat further includes a binder that bonds together the fibrous matrix, and wherein the amount of binder is decreased by at least about 2 wt % compared to the same paving mat in which the second mineral fibers are replaced by an equal amount of the polymer fibers.

8. The paving mat of claim 7 wherein the amount of binder is within a range of from about 15% to 20% by weight of the fibrous mat.

9. The paving mat of claim 1 wherein the mat has a stiffness in a machine direction within a range of from about 65 g-cm to about 110 g-cm.

10. The paving mat of claim 1, wherein the mat has an average tensile strength in the cross direction of within the range of from about 55 lbf (244.7 N) to about 70 lbf (311.4 N).

11. The paving mat of claim 1 wherein the first and second mineral fibers are glass fibers made from a glass which is essentially free of boron.

12. The paving mat of claim 1, wherein the fibrous mat has a weight of at least about 0.12 kg/$m^2$.

13. A paving mat for use in a paved surface comprising:

a fibrous mat including a fibrous matrix which is bonded together by a binder, the fibrous matrix comprising a mixture of mineral fibers in an amount within a range of from 61 wt % to about 85 wt % and polymer fibers in an amount within a range of from about 15 wt % to 39 wt %, the polymer fibers having a melting point greater than about 320° F. (160° C.);

the mat having a stiffness in a machine direction within a range of from about 65 g-cm to about 110 g-cm, and the mat having a load-elongation behavior such that when the mat is subject to tensile stress, the mat achieves at least 90% of its ultimate load at an elongation not greater than 5% of the specimen length in the direction of applied stress;

wherein the mat has an average tensile strength in the machine direction of at least about 70 lbf (311.4 N).

14. The paving mat of claim 13 wherein the ratio of mineral fibers/polymer fibers is within a range of from about 65/35 to about 85/15.

15. The paving mat of claim 13 wherein the binder comprises a mixture of different binders.

16. The paving mat of claim 15 wherein the binders in the binder mixture each have a melting point greater than about 160° C.

17. The paving mat of claim 15 wherein the binder mixture comprises a mixture of an acrylic resin and a formaldehyde resin.

18. The paving mat of claim 17 wherein the binder mixture further comprises a styrene-butadiene copolymer latex.

19. The paving mat of claim 13 wherein the mat has a stiffness in the machine direction within a range of from about 65 g-cm to about 95 g-cm.

20. The paving mat of claim 17 wherein the binder mixture comprises the acrylic resin in an amount within a range of from about 50 wt % to about 90 wt % and the urea formaldehyde resin in an amount within a range of from about 10 wt % to about 50 wt %.

21. The paving mat of claim 17 wherein the curing temperature is within a range of from about 350° F. (177° C.) to about 450° F. (232° C.).

22. The paving mat of claim 17 wherein the binder mixture is included in an amount within a range of from about 17% to about 30% by weight of the mat.

23. The paving mat of claim 13 wherein the polymer fibers have a diameter within a range of from about 5 denier to about 8 denier.

24. The paving mat of claim 13 wherein the mineral fibers are glass fibers.

25. The paving mat of claim 24 wherein the glass fibers are made from a glass which is essentially free of boron.

26. The paving mat of claim 13, wherein the fibrous mat has a weight of at least about 0.12 kg/m$^2$.

27. A paving mat for use in a paved surface comprising:

a fibrous mat including a fibrous matrix which is bonded together by a carboxy-modified acrylic binder, the fibrous matrix comprising a mixture of mineral fibers in an amount within a range of from 61 wt % to about 85 wt % and polymer fibers in an amount within a range of from about 15 wt % to 39 wt %, the polymer fibers having a melting point greater than about 320° F. (160° C.);

the mat having a stiffness in a machine direction within a range of from about 65 g-cm to about 110 g-cm, and the mat having a load-elongation behavior such that when the mat is subject to tensile stress, the mat achieves at least 90% of its ultimate load at an elongation not greater than 5% of the specimen length in the direction of applied stress;

wherein the mat has an average tensile strength in the machine direction of at least about 70 lbf (311.4 N).

28. The paving mat of claim 27 wherein the mat has a stiffness in the machine direction within a range of from about 65 g-cm to about 95 g-cm.

29. The paving mat of claim 27, wherein the fibrous mat has a weight of at least about 0.12 kg/m$^2$.

* * * * *